US005860531A

United States Patent [19]

Satoru et al.

[11] Patent Number: 5,860,531

[45] Date of Patent: Jan. 19, 1999

[54] CEREAL SEPARATOR USING SIZE AND SPECIFIC GRAVITY GRADING

[75] Inventors: Satake Satoru, Tokyo; Akihiko Katou, Higashihiroshima; Yasushi Hisamitsu, Higashihiroshima; Koji Arishige, Higashihiroshima, all of Japan

[73] Assignee: Satake Corporation, Tokyo, Japan

[21] Appl. No.: 820,707

[22] Filed: Mar. 18, 1997

[30] Foreign Application Priority Data

Mar. 29, 1996 [JP] Japan ..... 8-104170

[51] Int. Cl.[6] ..... B07B 9/02

[52] U.S. Cl. ..... 209/37; 209/30; 209/31; 209/37

[58] Field of Search ..... 209/44.1, 44.2, 209/44.3, 31, 36, 37, 139.1, 142, 466, 467

[56] References Cited

U.S. PATENT DOCUMENTS

| | | | |
|---|---|---|---|
| 306,266 | 10/1884 | Lane | 209/37 |
| 550,993 | 12/1895 | Miller | 209/44.3 |
| 1,284,872 | 11/1918 | Bryan | 209/31 |
| 4,318,806 | 3/1982 | Sataka . | |
| 4,466,542 | 8/1984 | Oetiker et al. | 209/467 |
| 4,469,230 | 9/1984 | Gorlitz et al. . | |
| 4,636,305 | 1/1987 | Mueller | 209/466 |
| 4,652,362 | 3/1987 | Mueller | 209/466 |
| 4,913,804 | 4/1990 | Muller | 209/44.2 |
| 4,971,684 | 11/1990 | Mueller | 209/467 |
| 5,087,351 | 2/1992 | Valentine, Sr. | 209/467 |
| 5,181,616 | 1/1993 | Le Gigan | 209/31 |
| 5,183,161 | 2/1993 | Mueller | 209/467 |

OTHER PUBLICATIONS

Japanese Patent Publication No. 6–51176.
Japanese Patent Publication No. 6–59463.
Japanese Patent Publication No. 8–4780.
Japanese Patent Publication No. 56–150470.
Japanese Patent Publication No. 57–81872.
Japanese Patent Publication No. 63–221874.
Japanese Patent Publication No. 5–274.

*Primary Examiner*—William E. Terrell
*Assistant Examiner*—Patrick Mackey
*Attorney, Agent, or Firm*—Darby & Darby

[57] ABSTRACT

A cereal separation apparatus includes a frame and a size grading device mounted at an upper portion of the frame for grading particles according to a size of the particles. An oscillating specific gravity grading device is mounted at a lower portion of the frame. An air flow-producing device produces an air flow for effecting the specific gravity grading. A feed passage feeds the particles, selected by the size grading device, from the size grading device to the specific gravity grading device. The size grading device comprises a perforated, hollow cylinder for grading the particles according to particle size. The cylinder is supported on the frame for rotation about an axis of the cylinder. The specific gravity grading device is supported on the frame through oscillation support portions. The apparatus further comprises a rotation drive device for rotating the hollow cylinder and an oscillation drive device for oscillating the specific gravity grading device. The rotation means and the oscillation drive means are operable independent of each other. An air passage connects the specific gravity grading means to the hollow cylinder so as to pass the air flow, produced by the air flow-producing means, which has passed through the specific gravity grading means, through the hollow cylinder.

5 Claims, 7 Drawing Sheets

CEREAL SEPARATOR USING SIZE AND SPECIFIC GRAVITY GRADING

BACKGROUND OF THE INVENTION

1. Field of the Invention

This invention relates to a cereal separation apparatus for removing inclusions or foreign matters, such as stones, from raw material of cereals such as rice grains, wheat grains and beans, thereby separating the cereals or cereal grains from foreign matters such as stones and straws, and more particularly to a cereal separation apparatus of a type comprising a frame, size grading means mounted at an upper portion of the frame for grading or selecting particles according to the particle size, oscillation- or vibration-type specific gravity grading means mounted at a lower portion of the frame, air flow-producing means for producing an air flow for effecting this specific gravity grading, and a feed passage for feeding the selected or graded raw material from the size grading means to the specific gravity grading means.

Herein, the term "size grading means" is referred to as a structure capable of grading raw material grains (i.e., particle-like matters to be graded) according to the size of the particle-like matters, and this size grading structure may have any mechanical construction as well as any grading principle. The term "size" or "particle size" of the particle-like matter is referred to as a dimension or magnitude in the direction of a minor axis of the particle-like matter.

Herein, the term "specific gravity grading means" is referred to as a structure capable of selecting the raw material grains (i.e., particle-like matters to be graded) according to the specific gravity or density of the particle-like matters, and this specific gravity grading structure can have any mechanical construction as well as any grading principle.

Herein, the term "air flow-producing means" is referred to as a structure capable of producing a flow of the air, and this structure can have any mechanical or electromechanical construction as well as any air flow-producing principle in so far as the structure can cause a pressure difference between its air suction side and its air discharge side so as to produce an air flow therebetween, and as the structure is of such a type that the air will not be substantially contaminated with oil or the like.

2. Related Art

Conventional cereal separation apparatuses of the type mentioned above are described, for example, in U.S. Pat. Nos. 4,971,684, 4,913,804 and 4,652,362.

As shown in FIG. 6, the apparatus 101, disclosed in U.S. Pat. No. 4,971,684, comprises a screening device 102 (serving as a size grading unit) having sorting screens 115 and 118 provided at an upper portion of a frame 108, and a stone sorter 105 (serving as a specific gravity grading unit) which comprises a perforated plate, and is provided at a lower portion of the frame 108. In this apparatus 101, the screening device 102 and the stone sorter 105 are combined together into an integral or unitary oscillation or vibration unit 150 supported on the frame 108 through oscillation or vibration supports 107. The apparatus 101 further comprises an exhaust connection piece 123 (serving as air flow-producing means) for producing an air flow for effecting the specific gravity grading, and a throw-off duct 121 (serving as a feed passage) for feeding the selected raw material from the screening device (size grading unit) 102 to the gravity grading unit. Reference numerals 112 and 113 denote respectively a non-oscillating cover, stationary relative to a floor 109, and a flexible sleeve 113.

In this apparatus 101, the so-called size grading is effected by the screening device 102, and thereafter the so-called specific gravity grading is effected by the stone sorter 105. More specifically, inclusions or foreign matters, such as sand, stone and wood chips, are removed from the raw material grains supplied from a product feed line 110 into the apparatus 101, and are discharged from discharge outlets 116, 120 and 136, and the grains, containing a relatively small amount of such foreign matter, is discharged from an outlet 135. The above U.S. Patent teaches further, in FIG. 3 and others, about circulating the air flow within a range of the stone sorter 105.

However, in the above apparatus 101, the screening device 102 and the stone sorter 105 are arranged in a vertical direction relative to each other, and are formed into the integral oscillation or vibration unit 150, and are vibrated in unison by oscillation or vibration applying mechanism. Therefore, a large load acts on a oscillation or vibration supports 107 of the oscillation unit 150, and therefore the apparatus lacks in durability.

And besides, because of this integral construction, regardless of the nature and conditions of the raw material grains 152 supplied from the product feed line 110 (for example, even when the raw material grains 152 contain a large amount of inclusion foreign matters 153 to be removed by the screening device 102, or even when the raw material grains 152 contain a large amount of inclusion foreign matters 154 to be removed by the stone sorter 105), the optimum vibrations can not be applied respectively to the screening device 102 and the stone sorter 105, and therefore the optimum grading of the raw material grains 152 according to the nature and conditions of the raw material grains 152 could not be effected.

Furthermore, although the screening device 102 can separate from the raw material grains 152 the inclusion foreign matters 153 mixed therein according to their size, this screening device 152 could not satisfactorily remove sand and dust adhering or sticking to the surfaces of the grains 152.

Herein, the term "raw material grains" is referred to as cereals or cereal grains supplied or charged into the cereal separation apparatus so that foreign matters can be separated and removed therefrom by this cereal separation apparatus.

Herein, the term "broken grain" is referred to as a cereal or cereal grain which is at least partially broken into a small particle-like form. The term "normal grains" is referred to as cereals or cereal grains of a normal shape excluding the broken grains. The term "mixture grains" is referred to as a mixture of normal grains and foreign matters other than the normal grains, and is usually referred to as those raw material grains from which foreign matters are partially separated and removed. The term "foreign matter" is usually referred to as those matters except the cereals or cereal grains, such as stone and straw, and in some cases, is also referred to as those grains except the normal grains, as defined for the mixture grains.

Herein, the term "larger", used for foreign matters such as stone, is referred to as that it is larger in size or diameter than the normal grain, and the term "smaller" is referred to as that it is smaller in size or diameter than the normal grain, where the term "size" or "diameter" is defined in connection with whether or not the relevant matter can pass through a hole such as a screen mesh within a normal time period during which the apparatus operates or functions, and usually this term is referred to as a length of a minimum diameter portion or a minor axis. Herein, the term "diameter" is equivalent to the term "size", and does not suggest that the relevant particle-like matter has a circular or oval sectional shape.

SUMMARY OF THE INVENTION

With the above problems in view, it is an object of this invention to provide a cereal separation apparatus which can solve or overcome at least part of the problems of the above prior arts.

Another object of the invention is to provide a cereal separation apparatus which is enhanced in durability.

A further object of the invention is to provide a cereal separation apparatus which is capable of effecting the good grading of raw material grains regardless of the nature and conditions of the raw material grains.

A still further object of the invention is to provide a cereal separation apparatus which is capable of effectively removing foreign matters, adhering to the raw material grains, therefrom.

According to the present invention, at least a part of the above objects have been achieved by a cereal separation apparatus of the above-mentioned type wherein the size grading means comprises a perforated, hollow cylinder for grading particles according to the particle size, and the cylinder is supported on the frame for rotation about an axis of the cylinder, and the specific gravity grading means is supported on the frame through oscillation or vibration support portions, and the apparatus further comprises rotation drive means for rotating the rotary grading, hollow cylinder, and oscillation or vibration drive means for oscillating or vibrating the specific gravity grading means, the rotation drive means and the oscillation drive means being operable independent of each other.

Herein, the term "rotation drive means" is referred to as a structure capable of rotating the rotary grading, hollow cylinder, and can have any mechanical or electromechanical construction and any rotation drive principle in so far as it can rotate the rotary grading, hollow cylinder. Namely, an energy of a drive source may be of any form, and besides a member, driven directly by the drive source, may be oscillated or vibrated, i.e. reciprocated as in a piston, instead of being rotated. The term "oscillation or vibration drive means" is referred to as a structure capable of oscillating or vibrating the specific gravity grading means, and can have any mechanical or electromechanical construction and any oscillation or vibration drive principle in so far as it can oscillate or vibrate the specific gravity grading means. Namely, an energy of a drive source may be of any form, and besides a member, driven directly by the drive source, may be rotated instead of being oscillated or reciprocated as in a piston.

In so far as the rotation drive power, produced by the rotation drive means, and the oscillation drive power, produced by the oscillation drive means, can be controlled independently of each other, the rotation drive means and the oscillation drive means do not always need to be separate from each other, and instead the operations of the rotation drive means and the oscillation drive means may be associated with each other. For example, the rotation drive means and the oscillation drive means may be coupled or connected to a common mechanical, or electromechanical, or electronic drive control means so that a ratio of the power, supplied to the rotation drive means, with respect to the power, supplied to the oscillation drive means, can be changed.

In a cereal separation apparatus according to a preferred embodiment of the invention, the oscillation drive means comprises drive means separate from the rotation drive means.

In a cereal separation apparatus according to a preferred embodiment of the invention, further comprising an air passage connecting or communicating the specific gravity grading means with the rotary grading, hollow cylinder so as to pass, through the rotary grading, hollow cylinder, the air flow produced by the flow-producing means and having passed through the specific gravity grading means. It is preferred that the apparatus further comprises a dust collector in an air passage extending between an opening in a side or peripheral wall of the rotary grading, hollow cylinder and a suction-side part of the air flow-producing means.

In the cereal separation apparatus of the invention, the rotary grading, hollow cylinder and the specific gravity grading means are driven independently of each other by the separate drive means, respectively. More specifically, the rotary grading, hollow cylinder is rotated at the upper portion of the frame by the rotation drive means, and the specific gravity grading means is oscillated at the lower portion of the frame by the oscillation drive means. Therefore, it is possible to avoid that an excessive load acts on the oscillation support portions of the specific gravity grading means, thereby enhancing the durability of the cereal separation apparatus. And besides, even if it happens to be that the nature and conditions of the raw material grains vary greatly from one lot to another, the optimum grading suited for the nature and conditions of the raw material grains can be achieved by adjusting the driving forces or powers of the separate drive means provided respectively for the rotary grading, hollow cylinder and the specific gravity grading means. For example, when a large amount of lightweight foreign matters, such as pieces of thread and straw, to be selected by the rotary grading, hollow cylinder, are contained in the raw material grains, the rotational speed of the rotary grading, hollow cylinder can be suitably adjusted, and when a large amount of inclusion foreign matters, such as small stone pieces, to be selected by the specific gravity grading means, are contained in the raw material grains, the (oscillation or vibration) frequency of the specific gravity grading means can be suitably adjusted. Thus, the optimum grading suited for the nature and conditions of the raw material grains can be effected.

In the cereal separation apparatus of the invention, the raw material grains, supplied or charged into the rotary grading, hollow cylinder, are subjected to a force, produced by the rotation of the rotary grading, hollow cylinder, to be graded according to their particle sizes, and at the same time foreign matters, adhering or sticking to the surfaces of the grains, are effectively removed therefrom by the friction between the grains. The raw material grains subjected to the size grading are thereafter supplied to the specific gravity grading means via the feed passage.

In the cereal separation apparatus according to one preferred embodiment of the invention, because of the provision of the air passage connecting or communicating the specific gravity grading means with the rotary grading, hollow cylinder so as to pass the air flow, produced by said the flow-producing means, through the rotary grading, hollow cylinder, it is possible to perform, in the rotary grading, hollow cylinder, the grading of the raw material grains according to their particle sizes, as well as the grading for removing lightweight foreign matters from the raw material grains by the air flow (that is, a kind of grading according to the weight).

In the cereal separation apparatus according to another preferred embodiment of the invention, because of the provision of the dust collector in the air passage extending between an opening in a side or peripheral wall of the rotary grading, hollow cylinder and the suction-side of the air flow-producing means, it is possible to draw the air in the rotary grading, hollow cylinder into the dust collector, to separate the lightweight foreign matters from the air in this dust collector, and to return this cleaned air to the air flow-producing means. Therefore, in this cereal separation apparatus, the foreign matters can be separated from the raw material grains with an aid of the circulating air flow, which makes it possible to have construction or structure of the apparatus compact.

The foregoing and other objects, features and advantages of the invention will be made clearer hereafter from the description of preferred embodiments referring to attached drawings.

DETAILED DESCRIPTION OF PREFERRED EMBODIMENTS

Figure 1:
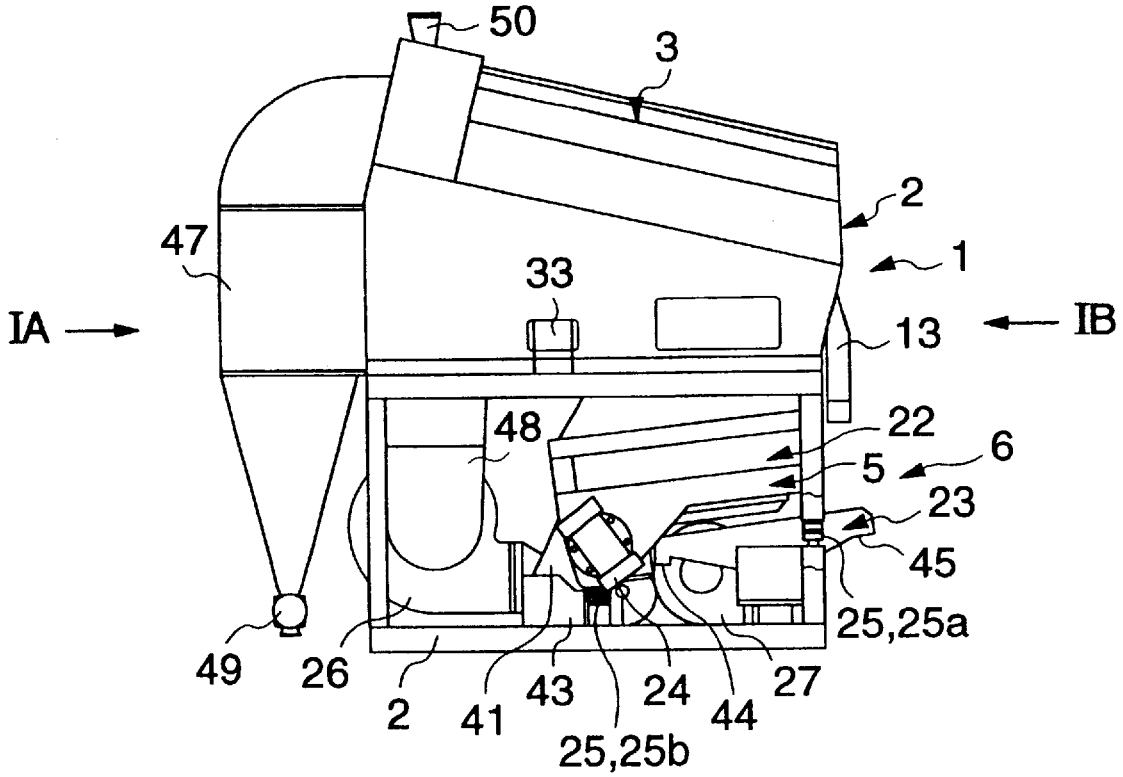
FIG. 1 is a front view of a cereal separation apparatus according to an embodiment of the invention.
Figure 1A:
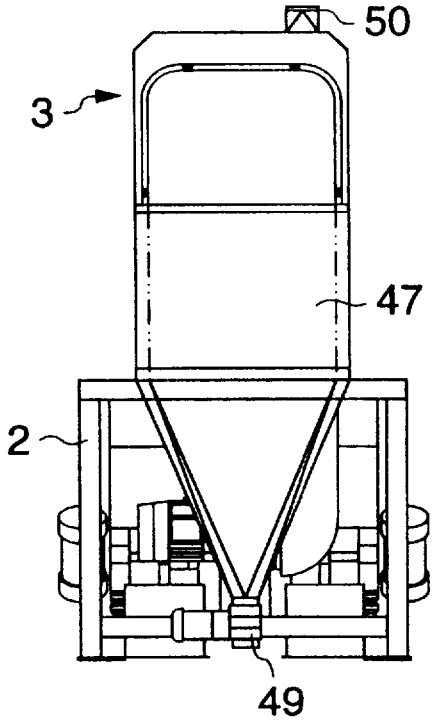
FIG. 1A is a side view of the apparatus as viewed in a direction of an arrow IA of FIG. 1.
Figure 1B:
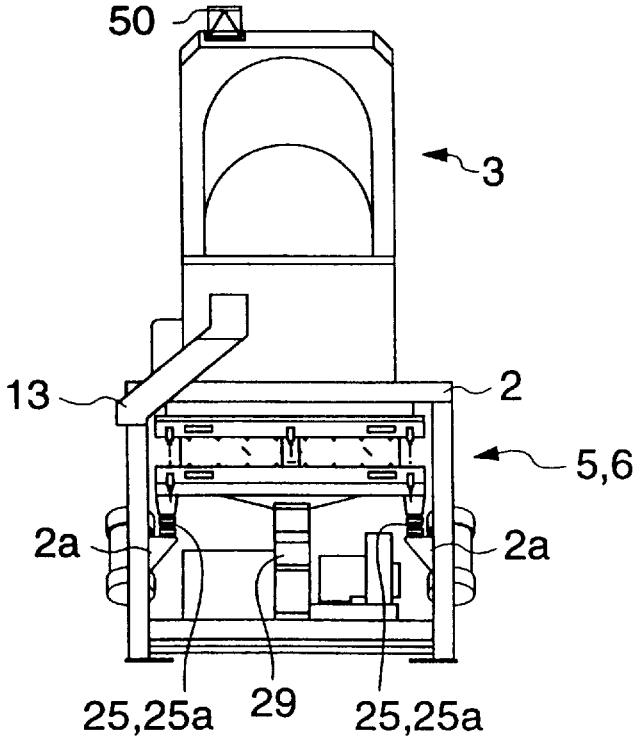
FIG. 1B is another side view of the apparatus as viewed in a direction of an arrow 1B of FIG. 1.
Figure 1C:
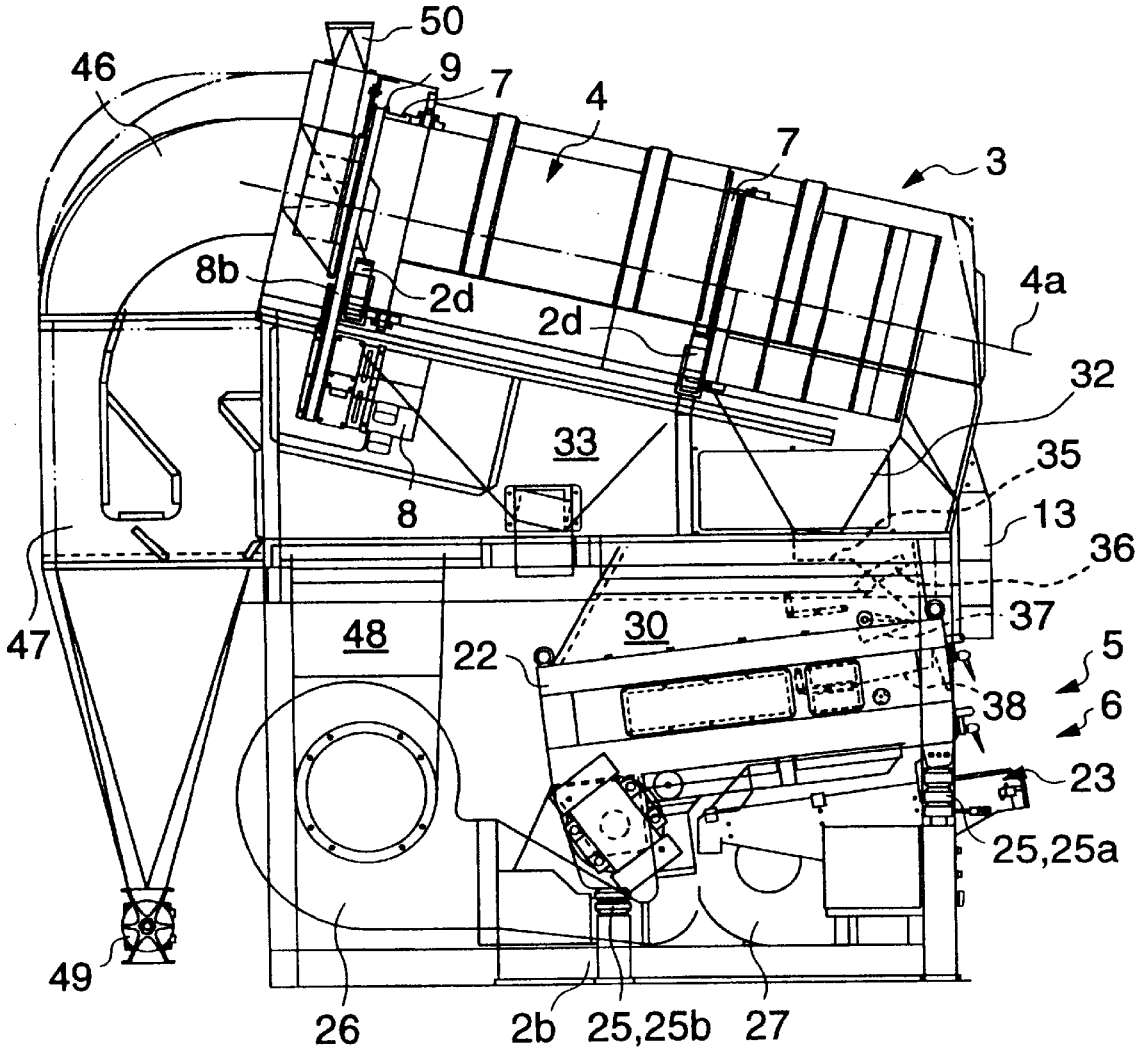
FIG. 1C is an enlarged view of the apparatus of FIG. 1, showing a detailed structure thereof.
Figure 1D:
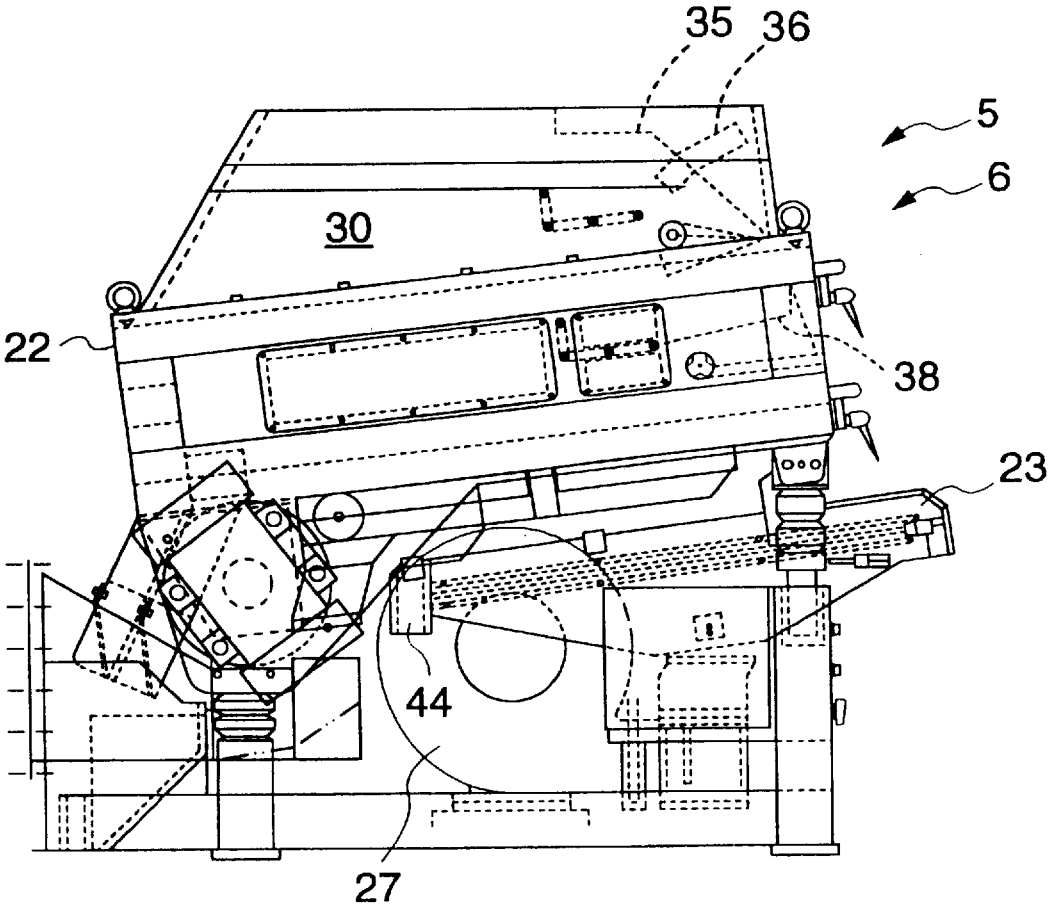
FIG. 1D is an enlarged view, of a stone sorter of the apparatus of FIG. 1, in which a detailed structure of the stone sorter is shown.

In a cereal separation apparatus 1, according to a preferred embodiment of the invention, shown in FIGS. 1, 1A to 1D and 2, a rotary grading, hollow cylinder 4, serving as size grading means 3, is rotatably mounted on an upper portion of a frame 2 in such a manner that an axis 4*a* of this cylinder 4 is slanting upwardly to the left. A stone sorter 6, serving as specific gravity grading means 5, is mounted on a lower portion of the frame 2 of the apparatus 1.

Rails 7, engaged respectively with sheaves 2*d* (FIG. 1C) provided within the frame 2, are mounted circumferentially on an outer peripheral surface of the rotary grading, hollow cylinder 4. A grooved rail 9 is also mounted circumferentially on the outer peripheral surface of the cylinder 4, and a belt 8*b* (FIG. 1C) is extended around a pulley 8*a* (FIG. 2), mounted on an output shaft of a motor 8 (serving as rotation drive means), and the grooved rail 9. The rotation of the output shaft of the motor 8 is transmitted to the rotary grading, hollow cylinder 4 via the belt 8*b* and the grooved rail 9, so that the rotary grading, hollow cylinder 4, supported by the above sheaves 2*d* through the rails 7, is rotated about an axis 4*a* of rotation thereof.

Figure 3:
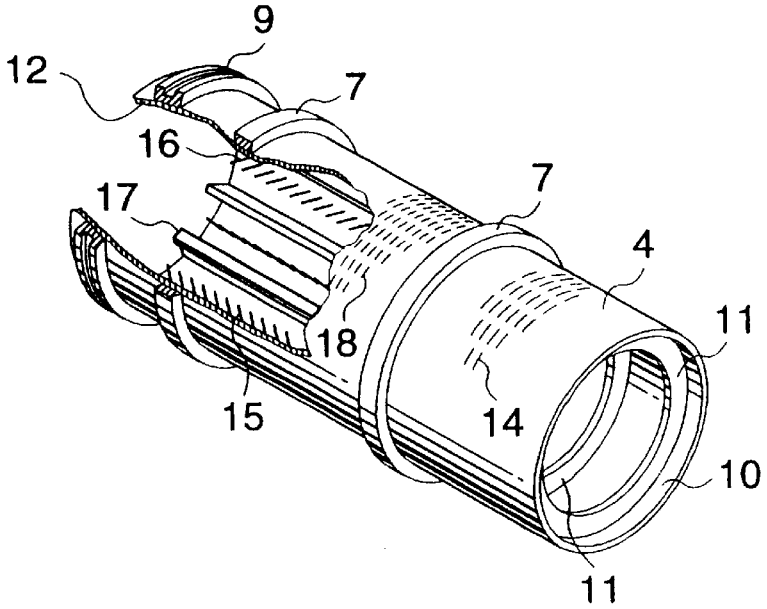
FIG. 3 is a partially-broken, oblique view of a rotary grading, hollow cylinder of the apparatus of FIG. 1.

As shown in detail in FIG. 3, a raw material grain supply port 12 is formed at a higher end of the inclined rotary grading, hollow cylinder 4, and a foreign matter discharge port 10 is formed at a lower end of the cylinder 4. A plurality of partition plates 11 (only two of which are shown in FIG. 3) are formed on that portion of an inner peripheral surface of the rotary grading, hollow cylinder 4 situated adjacent to the foreign matter discharge port 10, and are spaced from one another along the axis 4*a* thereof, each of the partition plates 11 extending in perpendicular to the axis 4*a* of this cylinder 4. A large number of through holes (perforations) 14, which are larger in size than grains, are formed through that portion of the peripheral wall of the rotary grading, hollow cylinder 4 lying between the innermost partition plate 11 nearest to the raw material grain supply port 12 and the foreign matter discharge port 10. A normal grain reception duct 32 is provided below that portion of the rotary grading, hollow cylinder 4 having the through holes 14, and serves as a feed passage which receives the grains having passed through the through holes 14, and feeds these grains to the stone sorter 6.

Figure 5:
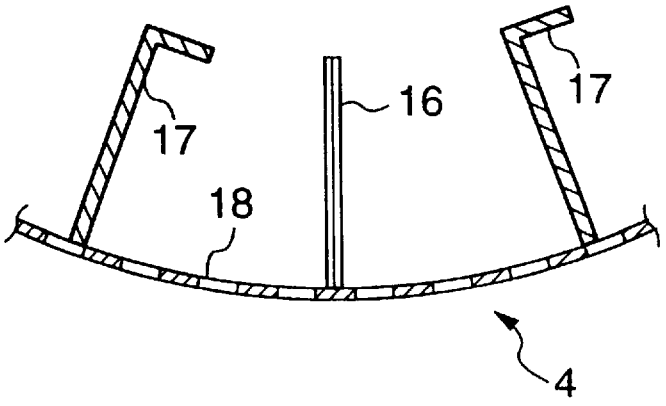
FIG. 5 is a sectional view of a part of a rotary grading, hollow cylinder of the apparatus of FIG. 1.
Figure 6:
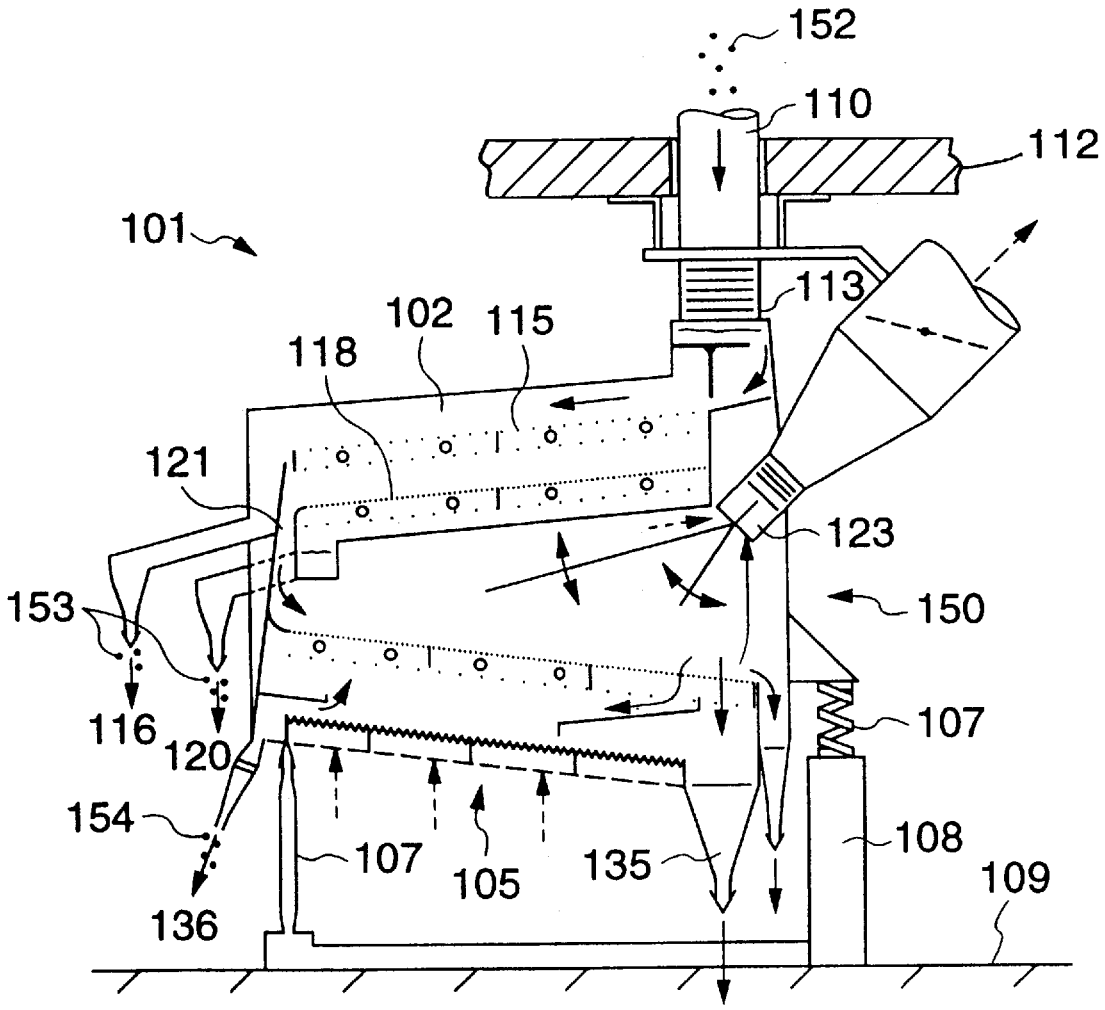
FIG. 6 PRIOR ART
FIG. 6 is a view similar to FIG. 2, but showing a conventional cereal separation apparatus.

As shown in FIG. 3, a plurality of comb-like forks 16 are formed in rows on a portion of the inner peripheral surface of the rotary grading, hollow cylinder 4 lying between the raw material grain supply port 12 and the innermost partition plate 11 remote from the foreign matter discharge port 10. Each comb-like fork 16 comprises a number of bars, needles or pins 15 which are embedded at one ends in the inner peripheral surface of the rotary grading, hollow cylinder 4, and extend radially inwardly therefrom. The bars or pins of each comb-like fork 16 being arranged in the form of a row extending in parallel with the axis 4*a* of the cylinder 4. Projection pieces 17 of an L-shaped cross-section for stirring (or agitating) purposes are formed on the inner peripheral surface of the rotary grading, hollow cylinder 4. Each of the projection pieces 17 is disposed between two adjacent comb-like forks 16 and 16 in parallel relation to the forks 16, that is, extending in parallel with the axis of rotation of the cylinder 4 (FIGS. 3 and 5). A large number of through holes (perforations) 18, which are smaller in size than normal grains, are formed through that portion of the peripheral wall of the rotary grading, hollow cylinder 4 lying between the raw material grain supply port 12 and the innermost partition plate 11 remote from the foreign matter discharge port 10. A small-size matter discharge duct 33 is provided below that portion of the rotary grading, hollow cylinder 4 having the through holes 18, and receives small-size matters, such as broken grains, having passed or leaked through the through holes 18, and discharges such smaller matters to the exterior of the apparatus 1.

The size grading means 3 of the cereal separation apparatus 1 according to one preferred embodiment of the invention may be of any suitable type in so far as the rotary grading, hollow cylinder 4 is used, and the size grading means 3 may be any one of the rotary size-grading means as disclosed, for example, in U.S. Pat. No. 4,469,230 and Japanese Patent Unexamined Publication Nos. 57-81872 and 56-150470 incorporated herein by reference thereto.

Reference numeral 50 denotes a supply hopper for supplying or charging the raw material grains into the rotary grading, hollow cylinder 4, and reference numeral 13 denotes a large-size foreign matter discharge duct. Large-size foreign matters, which are contained in the raw material grains supplied into the rotary grading, hollow cylinder 4, and fail to pass through the through holes 14 and 18, reach the foreign matter discharge port 10, and are discharged to the exterior of the apparatus 1 through the large-size foreign matter discharge duct 13.

Figure 4:
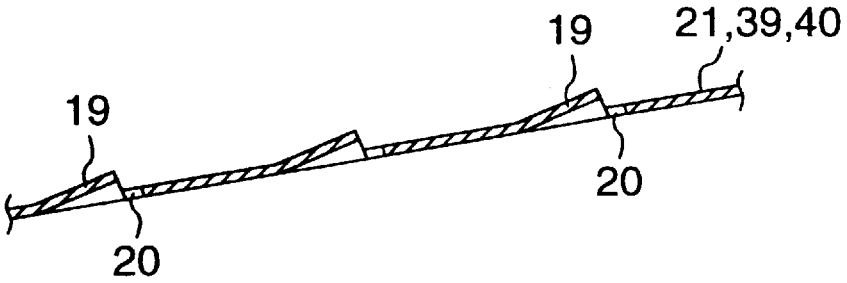
FIG. 4 is a sectional view of a part of a stone sorting-grading plate of the apparatus of FIG. 1.

The stone sorter 6 includes a primary or first-stage grading frame 22, and a secondary or second-stage grading frame 23 which is provided below the primary grading frame 22, and is fixed thereto. As shown in detail in FIG. 4, a pair of upper and lower stone sorting-grading plates 21 and 39 are provided in an inclined manner in the primary grading frame 22, each of these plates 21 and 39 having a number of projections 19 and air jet holes 20 associated respectively with the projections 19. A stone sorting-grading plate 40, which is similar in construction to each of the stone sorting-grading plates 21 and 39, is provided in an inclined manner in the secondary grading frame 23.

The stone sorter 6 is pivotally or swingably supported at one end of its bottom on support bases 2*a* of the frame 2 of the apparatus 1 through a joint 25*a* (serving as an oscillation support portion 25), and also is pivotally supported at the other end of the bottom thereof on a bottom portion 2*b* of the frame 2 of the apparatus 1 through joints 25*b* (serving as an oscillation support portion 25), so that the stone sorter 6 can be swung. The primary grading frame 22 of the stone sorter 6 is connected to an oscillation- or vibration-generation motor (serving as oscillation drive means) 24, so that the stone sorter 6 can be oscillated or vibrated as a whole by this motor 24.

Examples of the joints 25*a* and 25*b* serving as the oscillation support portions 25 include a device, such as vibration-damping or absorbing rubber and air cushion or pneumatic cylinder, which can withstand a relative movement and a large load in a plane of oscillation or vibration of the stone sorter 6.

A fan 26 for supplying an air flow or stream to the stone sorting-grading plates 21 and 39 is connected to the bottom of the primary grading frame 22 via a bellows tube 28, and a fan 27 for supplying an air flow to the stone sorting-grading plate 40 is connected to the bottom of the secondary grading frame 23 via a bellows tube 29.

Within the frame 2 of the apparatus 1, an air collection chamber 30 is formed above the primary grading frame 22 of the stone sorter 6, and this air collection chamber 30 is connected via an air duct 31, serving as an air passage, to a space around the rotary grading, hollow cylinder 4 in the vicinity of the foreign matter discharge port 10 of this cylinder 4. Part of the air passage 31 is formed by a bellows tube 34 so as to prevent the oscillation or vibration of the stone sorter 6 from being transmitted to the size grading means 3.

The interior of the rotary grading, hollow cylinder 4 is connected to one end of a duct 46 through a region of the raw material grain supply port 12, and the other end of the duct 46 is connected to a suction side of a dust collector 47. A discharge side of the dust collector 47 is connected to the suction side of the fan 26 via a clean air supply duct 48. Reference numeral 49 denotes a dust valve for allowing to discharge dust, separated from the air by the dust collector 47, to the exterior of the apparatus 1.

A feed passage 35, serving as guide means, is provided above the stone sorter 6. This feed passage 35 receives grains and others particle-like matters mixed therewith from the normal grain reception duct 32, and feeds them to the stone sorting-grading plates 21 and 39 of the primary grading frame 22 of the stone sorter 6. A guide trough 36 for receiving a part of the grains flowing along the feed passage 35 and for feeding the part to a guide plate 37 is provided at the feed passage 35. The guide plate 37 is provided between the guide trough 36 and the upper stone sorting-grading plate 21, and guides the grains, fed to the guide plate 37, to a generally central portion of the upper stone sorting-grading plate 21. Those grains in the feed passage 35, which flow down beyond the guide trough 36, flow onto a guide plate 38, provided between the upper and lower stone sorting-grading plates 21 and 39, and are guided by this guide plate 38 to a generally central portion of the lower stone sorting-grading plate 39.

The primary grading frame 22 is connected at the lower ends of the inclined stone sorting-grading plates 21 and 39 to a product grain or normal grain discharge duct 41, and also is connected at the higher ends of the stone sorting-grading plates 21 and 39 to a mixture grain discharge duct 42. The mixture grain discharge duct 42 is connected at its lower end to the secondary grading frame 23 so as to feed mixture grains thereto. Reference numeral 43 denotes a transport or transfer duct for feeding the grains, discharged from the product or normal grain discharge duct 41, to a subsequent processing step.

The secondary grading frame 23 is connected at the lower end of the inclined stone sorting-grading plate 40 to a product grain discharge duct 44, and also is connected at the higher end of the stone sorting-grading plate 40 to a stone discharge duct 45.

The stone sorter 6, serving as the specific gravity grading means 5 of the apparatus 1 according to one preferred embodiment of the invention, is not limited to the illustrated structure, and it may be any of the specific gravity grading devices as disclosed, for example, in U.S. Pat. No. 4,318,806 and Japanese Patent Unexamined Publication Nos. 63-221874 and 5-274 incorporated herein by reference thereto.

The operation of the cereal separation apparatus 1, thus constructed, according to one preferred embodiment of the invention will now be described.

Before the raw material grains are supplied to the apparatus 1, the rotation of the rotary grading, hollow cylinder 4 by the motor 8 (serving as the rotation drive means) and the oscillation or vibration of the stone sorter 6 by the oscillation- or vibration-generating motor 24 (serving as the oscillation or vibration drive means) are started.

When the raw material grains are supplied from the supply hopper 50 to the rotary grading, hollow cylinder 4 rotating in an inclined manner, the raw material grains flow toward the lower end of the inclined rotary grading, hollow cylinder 4, while being raked up or raised by the stirring projection pieces 7 and the comb-like forks 16 in accordance with the rotation of the rotary grading, hollow cylinder 4, to drop thereafter in a scattered or distributed manner, so that the raw material grains are stirred or mixed. Meanwhile, the air from the fan 26 passes through the stone sorter 6 and the air passage 31, and flows through the rotary grading, hollow cylinder 4 from the foreign matter discharge port 10 to the raw material grain supply port 12. Therefore, the raw material grains, which are being stirred, is exposed to the air stream flowing through the rotary grading, hollow cylinder 4 from the foreign matter discharge port 10 to the raw material supply port 12. As a result, lightweight foreign matters, such as powder dust, pieces of thread and straw, adhering or sticking to the surfaces of the raw material grains, are blown off by this air stream, and is drawn into the dust collector 47 through the raw material supply port 12. The air, which is separated from the foreign matters in the dust collector 47, and is therefore cleaned, is drawn through the clean air supply duct 48 by the fan 26. The foreign matters, collected in the dust collector 47, are discharged to the exterior of the cereal separation apparatus 1 via the dust valve 49.

Small-size foreign matters, such as broken grains and sand, contained in the raw material grains, pass or leak to the outside of the rotary grading, hollow cylinder 4 through the through holes 18 to reach the small-size matter discharge duct 33 when the raw material grains, introduced into the rotary grading, hollow cylinder 4, move from the raw material grain supply port 12 to the innermost partition plate 11 remote from the foreign matter discharge port 10. The small-size foreign matters are discharged further from the discharge duct 33 to the exterior of the apparatus 1. When the grains are subjected to a force produced by the rotation of the rotary grading, hollow cylinder 4, small-size foreign matters such as sand and dust, adhering or sticking to the surfaces of the grains, are removed therefrom by the friction between the grains, and are discharged to the exterior of the apparatus 1 through the through holes 18 and the small-size matter discharge duct 33.

Normal grains, as well as foreign matters of generally the same size as that of the normal grains, reach the partition plates 11, and then pass or leak into the normal grain reception duct 32 through the through holes 14 formed through that portion of the peripheral wall of the rotary grading, hollow cylinder 4 lying between the innermost partition plate 11 and the foreign matter discharge port 10, and are further fed to the feed passage 35 for the stone sorter 6.

Large-size foreign matters, larger in size than the through holes 14, reach the foreign matter discharge port 10 and flow out therefrom, and are discharged to the exterior of the apparatus 1 via the discharge duct 13.

The grains or particle-like matters, including stone pieces of generally the same size as that of the normal grains, which are fed to the feed passage 35, flow down therealong, are then fed to the guide trough 36. About a half of the grains thus fed to the guide trough 36 are further fed to the upper stone sorting-grading plate 21 via the guide plate 37. The other half of the grains flow beyond the guide trough 36 to reach the guide plate 38, and are further fed to the lower stone sorting-grading plate 39 via the guide plate 38.

By the oscillation- or vibration-generating motor 24, the stone sorting-grading plates 21, 39 and 40 are oscillated or vibrated obliquely upwardly and downwardly (for example, generally in their respective planes in which these plates 21, 39 and 40 lie or extend, respectively) integrally or in unison with the primary grading frame 22 and the secondary grading frame 23.

Figure 2:
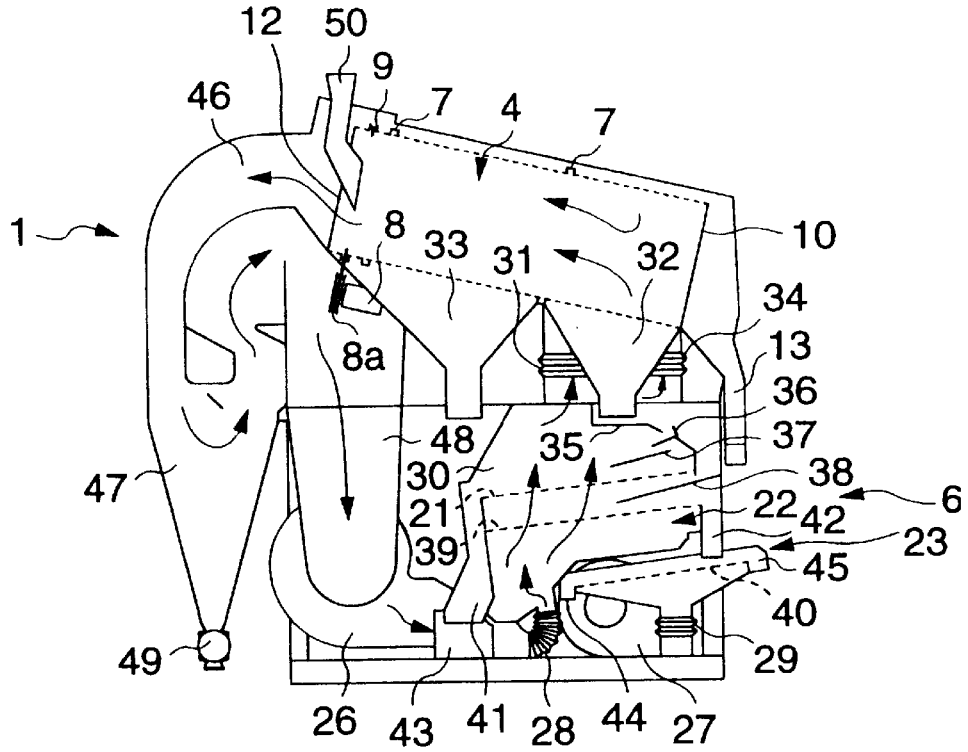
FIG. 2 is a diagrammatic front view of the apparatus of FIG. 1, illustrating an operation thereof.

As shown in FIG. 2, the air flow from the fan 26 passes upwardly through the air jet holes 20 (FIG. 4) in the stone sorting-grading plates 21 and 39, and therefore most of the normal grains of a low specific gravity among the particle-like matters, fed to each of the stone sorting-grading plates 21 and 39, float off the stone sorting-grading plate 21, 39, and flow toward the lower end of the inclined stone sorting-grading plate 21, 39, and are fed to the transport duct 43 via the product or normal grain discharge duct 41. Foreign matters, such as stone pieces, of a higher specific gravity among the particle-like matters on each of the stone sorting-grading plates 21 and 39 are moved or pushed upwardly toward the higher end of the inclined stone sorting-grading plate 21, 39 by the projections 19 in accordance with the oscillation or vibration of the stone sorting-grading plate 21, 39, and are fed to the mixture grain discharge duct 42, and are further fed to the stone sorting-grading plate 40 of the secondary grading frame 23. Part of the normal grains which have not been separated are also fed, together with the stone pieces etc., to the stone sorting-grading plate 40 of the secondary grading frame 23 via the mixture grain discharge duct 42.

As shown in FIG. 2, the air flow from the fan 27 passes upwardly through the air jet holes 20 (FIG. 4) in the stone sorting-grading plate 40, and therefore the normal grains among the mixture grains (which contains the normal grains and the small stone pieces) fed to the stone sorting-grading plate 40, float off the stone sorting-grading plate 40, and flow toward the lower end of the inclined stone sorting-grading plate 40, and are fed to the product or normal grain discharge duct 44, and are further discharged to the exterior of the apparatus 1. On the other hand, the small stone pieces are moved or pushed upward toward the higher end of the stone sorting-grading plate 40 by the projections 19 in accordance with the oscillation or vibration of the stone sorting-grading plate 40, and are fed to the stone discharge duct 45 with substantially no grain contained therein, and are further discharged to the exterior of the apparatus 1.

The air flow from the fan 26, which has passed upwardly through the air jet holes 20 in the stone sorting-grading plates 21 and 39, enters the air collection chamber 30, and then is fed to the rotary grading, hollow cylinder 4 via the air passage 31, and recovers or collects lightweight foreign matters, contained in the raw material grains, while passing through the rotary grading, hollow cylinder 4, and reaches the suction side of the dust collector 47. The air flow, from which the foreign matters are separated in the dust collector 47, is again fed as clean air to the fan 26, thus effecting the circulation of the air flow.

What is claimed is:

1. A cereal separation apparatus comprising:

a frame;

size grading means mounted at an upper portion of said frame for grading particles according to a size of the particles;

oscillating specific gravity grading means mounted at a lower portion of said frame;

air flow-producing means for producing an air flow for effecting the specific gravity grading; and a feed passage for feeding the particles, selected by said size grading means, from said size grading means to said specific gravity grading means;

wherein said size grading means comprises a perforated, hollow cylinder for grading the particles according to the particle size, and said cylinder is supported on said frame for rotation about an axis of said cylinder;

wherein said specific gravity grading means is supported on said frame through oscillation support portions;

wherein said apparatus further comprises rotation drive means for rotating said hollow cylinder, and oscillation drive means for oscillating said specific gravity grading means, said rotation means and said oscillation drive means being operable independent of each other; and an air duct connecting said specific gravity grading means to said hollow cylinder so as to pass the air flow, produced by said air flow-producing means, which has passed through said specific gravity grading means, through said hollow cylinder.

2. Apparatus according to claim 1, wherein which said oscillation drive means comprises drive means separate from said rotation drive means.

3. Apparatus according to claim 1, further comprising a dust collector in an air passage extending between an opening in a peripheral wall said rotary grading, hollow cylinder and a suction-side of said air flow-producing means.

4. A cereal separation apparatus comprising:

a frame;

a perforated, hollow cylinder mounted at an upper portion of said frame for grading particles according to a size of the particles, said cylinder being supported on said frame for rotation about an axis of said cylinder;

a stone sorter mounted at a lower portion of said frame;

a fan producing an air flow for effecting the stone sorter; and a feed passage for feeding the particles, selected by said perforated, hollow cylinder, from said perforated, hollow cylinder to said stone sorter;

wherein said stone sorter is supported on said frame through oscillation support portions;

wherein said apparatus further comprises a motor for rotating said hollow cylinder, and another motor for oscillating said stone sorter, said one and another motor being operable independent of each other; and an air duct connecting said stone sorter to said hollow cylinder so as to pass the air flow, produced by said fan, which has passed through said stone sorter, through said hollow cylinder.

5. Apparatus according to claim 4, further comprising a dust collector in an air passage extending between an opening in a peripheral wall of said hollow cylinder and a suction-side of said fan.

* * * * *

UNITED STATES PATENT AND TRADEMARK OFFICE

CERTIFICATE OF CORRECTION

PATENT NO. : 5,860,531

DATED : January 19, 1999

INVENTOR(S) : Satoru SATAKE et al.

It is certified that error appears in the above-identified patent and that said Letters Patent is hereby corrected as shown below:

On the title page,[75]Inventors, "SATAKE SATORU" should be --SATORU SATAKE--
On the title page, under [19], "Satoru" should be --Satake--.

Signed and Sealed this

Twenty-seventh Day of July, 1999

*Attest:*

Q. TODD DICKINSON

*Attesting Officer*

*Acting Commissioner of Patents and Trademarks*